US011421362B2

(12) United States Patent
Demange et al.

(10) Patent No.: US 11,421,362 B2
(45) Date of Patent: Aug. 23, 2022

(54) NEEDLING LOOM WITH ELLIPTICAL TYPE MOVEMENT, TABLE FOR SUCH A NEEDLING LOOM AND MANUFACTURING METHOD OF SUCH A TABLE

(71) Applicant: ANDRITZ ASSELIN-THIBEAU, Elbeuf (FR)

(72) Inventors: Frédéric Demange, Montville (FR); Jean-Christophe Laune, La Londe (FR)

(73) Assignee: ANDRITZ ASSELIN-THIBEAU, Elbeuf (FR)

( * ) Notice: Subject to any disclaimer, the term of this patent is extended or adjusted under 35 U.S.C. 154(b) by 0 days.

(21) Appl. No.: 16/928,058

(22) Filed: Jul. 14, 2020

(65) Prior Publication Data

US 2021/0017683 A1 Jan. 21, 2021

(30) Foreign Application Priority Data

Jul. 17, 2019 (FR) ..... 19 08072

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 18/00; D04H 1/46; D04H 3/105; D04H 5/02; D04H 11/08; D04H 13/005; D04H 3/102
(Continued)

(56) References Cited

U.S. PATENT DOCUMENTS 3,112,548 A * 12/1963 Smith, II ..... D04H 1/46 28/108
3,122,815 A * 3/1964 Smith, II ..... D04H 18/02 28/115
(Continued)

FOREIGN PATENT DOCUMENTS

AT 406391 B * 4/2000 ..... D04H 18/02
DE 43 20 035 A1 2/1994 ..... D04H 18/02
(Continued)

OTHER PUBLICATIONS

Search Report dated Mar. 24, 2020 in related application No. FR 19 08072.

*Primary Examiner* — Amy Vanatta
(74) *Attorney, Agent, or Firm* — Renner, Kenner, Greive, Bobak, Taylor & Weber

(57) ABSTRACT

Needle machine comprising at least one needle plate, from which projects an array of needles, means for imparting an elliptical, reciprocating motion to the needles and at least one support table drilled with an array of through holes, or which it is intended to pass in a direction MD, being supported on it, a fabric or web of fibres to be consolidated by needling, the each executing an elliptical, reciprocating motion in the respective through holes, each having an upper respective opening on the fabric support side, a lower respective opening on the opposite side and an inner sidewall extending between the two upper and lower openings, characterised in that each hole is machined so that there is a longitudinal section with a greater dimension MD in which the upper respective opening of the hole has a greater dimension in the direction MD and, in this longitudinal section of greater dimension MD, the inner sidewall of the hole is defined, at least in its upper region, by two left and right lines inclined to the vertical and converging downwards, the angles of inclination of the two lines to the
(Continued)

vertical being of opposite sign and in particular each having an absolute value of between 2 and 30° respectively, in particular having the same absolute value.

13 Claims, 4 Drawing Sheets

(58) Field of Classification Search
USPC ..... 28/114, 115
See application file for complete search history.

(56) References Cited

U.S. PATENT DOCUMENTS 4,172,174 A * 10/1979 Takagi ..... D04H 1/485 428/295.7
4,277,531 A * 7/1981 Picone ..... D04H 3/10 442/367
4,937,924 A * 7/1990 Leuchtenmuller ..... D04H 18/02 28/107
5,148,584 A 9/1992 Fehrer ..... 28/115
5,384,944 A * 1/1995 Minichshofer ..... D04H 18/00 28/115
5,732,453 A 3/1998 Dilo et al. ..... 28/114
5,894,643 A * 4/1999 Fehrer ..... D04H 18/02 28/115
6,622,359 B2 * 9/2003 Legl ..... D04H 18/02 28/107
2002/0066169 A1 6/2002 Legl ..... 28/107
2020/0378045 A1 * 12/2020 Dilo ..... D04H 18/02

FOREIGN PATENT DOCUMENTS

DE 102005034144 B3 * 12/2006 ..... D04H 18/02
EP 1 939 343 A2 7/2008 ..... D04H 18/00
FR 2874937 A3 * 3/2006 ..... D04H 18/02
GB 2325249 A * 11/1998 ..... D04H 18/02

* cited by examiner

[Fig. 1]
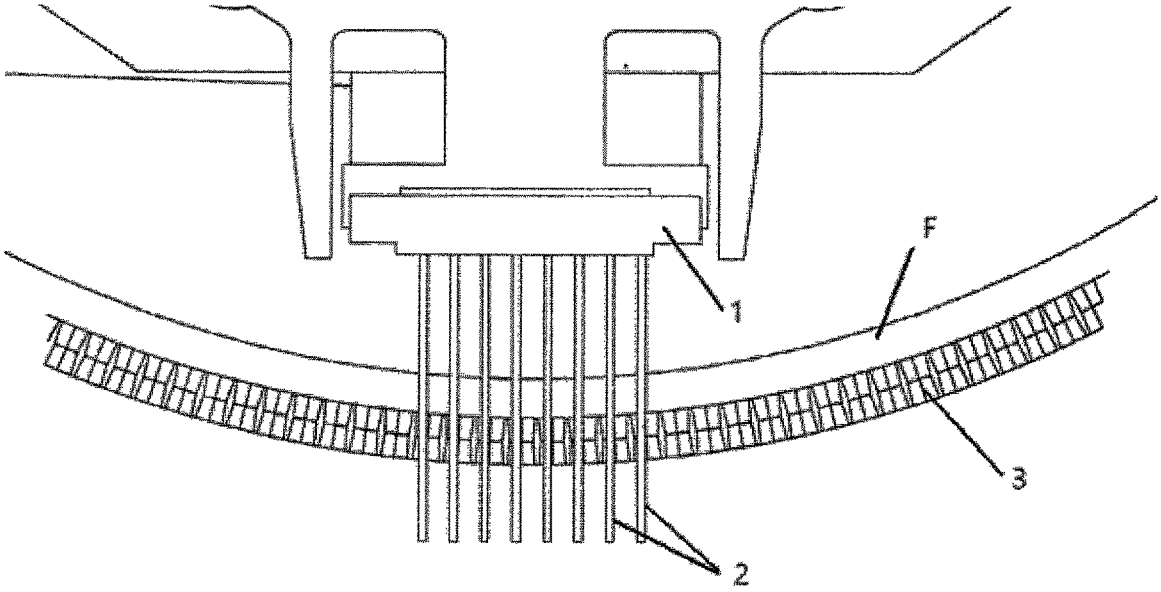
[Fig. 2]
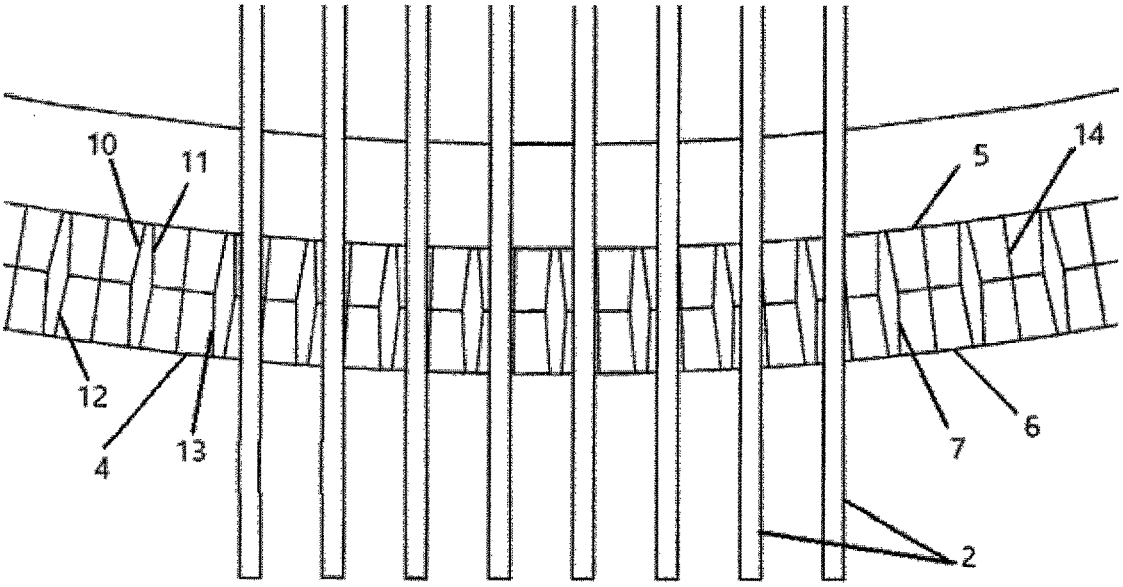

[Fig. 3]
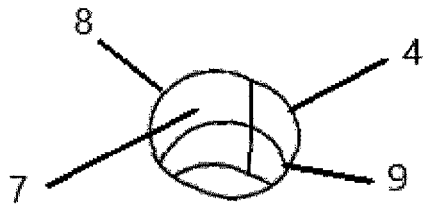
[Fig. 4]
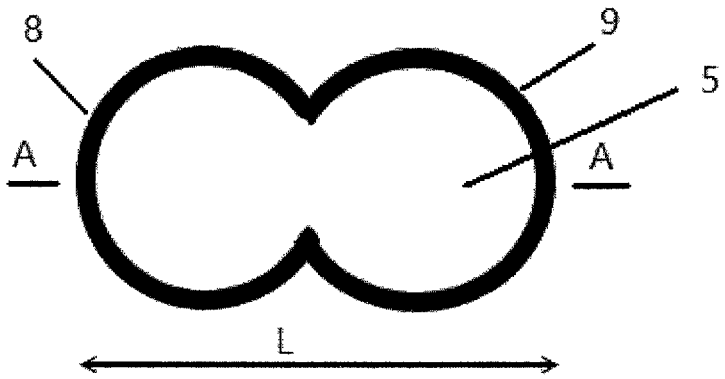
[Fig. 5]
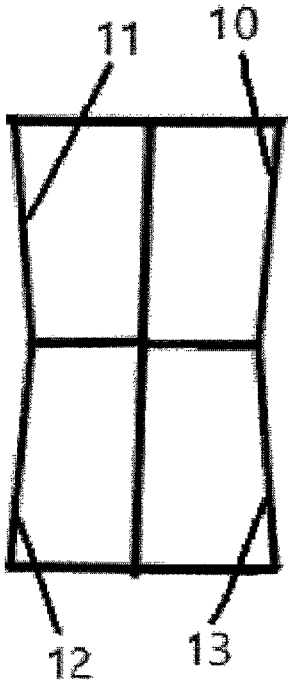

[Fig. 6]
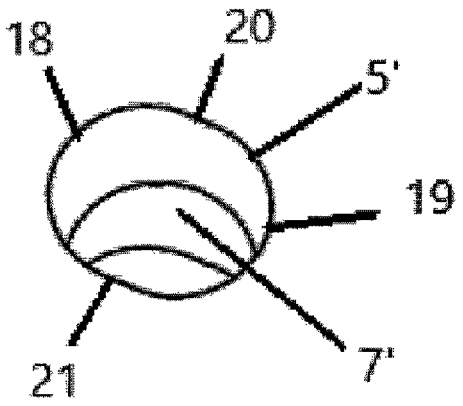
[Fig. 7]
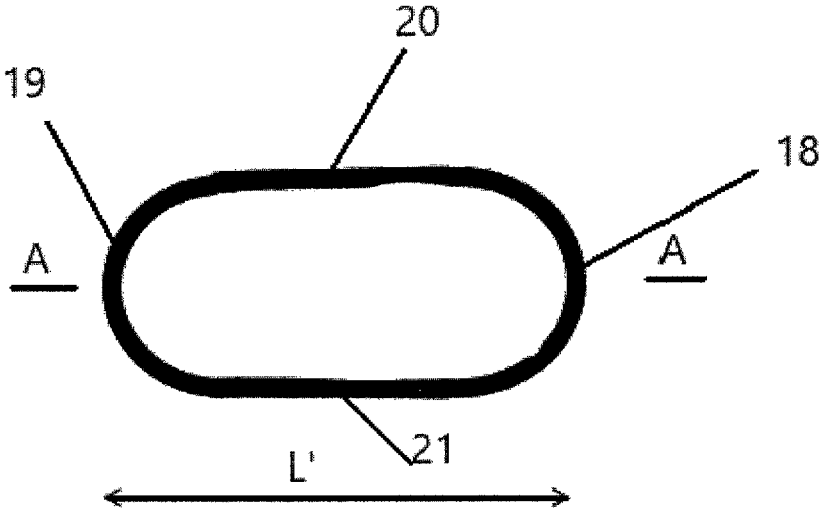

[Fig. 8]
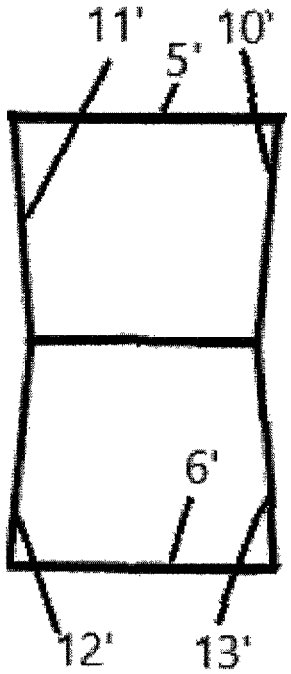

NEEDLING LOOM WITH ELLIPTICAL TYPE MOVEMENT, TABLE FOR SUCH A NEEDLING LOOM AND MANUFACTURING METHOD OF SUCH A TABLE

The present invention relates to a needling device, or needle machine, comprising at least one needle plate whose needles are driven by a drive mechanism that imparts a so-called elliptical motion to the needles and at least one table to support a web of fibres, in particular non-woven, passing in front of the needles in a direction MD to be needled to consolidate it, the table being drilled with an array of holes through which the needles reciprocate after passing through the web of fibres to be consolidated supported by the table.

The present invention also relates to a table and/or a stripper comprising an array of through holes for use in a needle machine of this type.

Needle machines are already known from the prior art, for example from FR-A1-2909104, in the name of the applicant, with elliptical motion comprising a table drilled with an array of circular, cylindrical holes, through which pass needles with a horizontal component of motion MD, in particular an elliptical motion, the needles not only moving vertically, perpendicular to the plane of the web passing in front of them, but also having a component of motion in the direction MD.

Due to the vertical and horizontal motion of the needles, the circular, cylindrical holes must have a large diameter to allow the needles to pass downwards and then upwards through the holes, in spite of their elliptical motion. The density of the holes, and therefore the density of the needles, is therefore limited meaning that the needling cannot achieve such good consolidation as one would desire or if, in spite of everything a table is made with a high needle density, the table becomes fragile due to the high proportion of drilling in relation to the material around the holes.

A needle machine is known from DE 43 20 035-A1 that has a needle plate and a support table drilled with an array of through holes, the through holes being slotted with several needles passing through the same slotted hole with a vertical up and down motion.

Needle machines are also known from FR 2 817 562-A1 and FR 2 738 846-A1 according to the preamble of claim 1.

The present invention aims to overcome these problems of the prior art by proposing a table drilled with holes for a needling device, or needle machine, as well as a needling device, or needle machine of the type with elliptical motion, which improves the quality of the needling, in particular by increasing the density of the holes without adversely affecting the overall strength of the drilled table.

According to the invention, a needle machine is as defined in claim 1.

Preferably, the edge of the upper opening is in the form of a slot, meaning that, in the horizontal plane parallel to the direction CD and to the direction MD or the horizontal plane CD-MD, it has a greater dimension in the direction MD and greater than the greatest dimension in the direction CD.

Preferably, the edge of the lower opening is in the form of a slot, meaning that, in the horizontal plane CD-MD, it has a greater dimension in the direction MD and greater than the largest dimension in the direction CD.

According to a preferred method of implementation, the edge of the upper opening and/or the edge of the lower opening, in the horizontal plane, that is in the plane parallel to the direction MD and to the direction CD, consist(s) of two circular arcs, or quasi circular arcs, in particular of the same radius, each subtending an angle greater than 180° but lower than 360°, with the distance between the two centres lower than the sum of their two radii, in particular less than double the radius in the case where they have the same radius, so as to form a FIG. 8.

According to another preferred method of implementation, the edge of the upper opening and/or the edge of the lower opening viewed from above, that is projected onto the horizontal plane, or the plane parallel to the direction MD and to the direction CD, has or have the shape of a slot comprising two ends in the form of semi-circular arcs, or quasi semi-circular arcs, of the same radius, linked by two straight sections, in particular mutually parallel in the direction MD.

According to one preferred and advantageous method of implementation, making the table and or stripper very compact, with many holes, in particular a majority of holes, preferably essentially all the holes, still more preferably each hole, is machined so that there is a longitudinal section with a greater dimension MD in which the respective upper opening of the hole is greatest in the direction MD and, on the longitudinal section with the largest dimension MD, of the inner sidewall of the hole is defined, at least in its upper region, by two left and right lines inclined to the vertical and converging downwards, the angles of inclination of the two lines to the vertical being of opposite sign and in particular each has an absolute of between 2 and 30° respectively, in particular has the same absolute value.

Preferably, in the longitudinal section with the greater dimension MD, the inner sidewall is defined by an upper right line, a lower right line, a lower left line and an upper left line, the upper left and right lines each being inclined to the vertical and converging downwards, the lower left and right lines each being inclined to the vertical, and converging upwards, the upper left line being parallel to the lower right line and the lower left line being parallel to the upper right line.

Preferably, the angles of inclination to the vertical of the lower right, lower left, upper right and upper left lines are equal to each other in absolute value, in particular between 2° and 15°, so that at least in the larger longitudinal section MD, the wall is essentially symmetrical with respect to the vertical plane CD, in particular symmetrical with respect to the vertical plane CD.

Preferably, the points where the upper left line and the lower left line and the lower right line and the upper right line respectively join are essentially half way between the two upper and lower openings, in particular half way between the two upper and lower openings.

By thus providing a wider section either of a V shape in the case of a table of small thickness, or an X shape in the case of a thicker table, during manufacture of the drilled support table, less material is removed, in particular drilling of the table is limited to those places at which the needles must be allowed to pass, enabling the drilled proportion table to be limited, thereby permitting the holes to be closer together without adversely affecting the overall strength of the table, and increasing the density of the holes and therefore the needles and consequently the efficiency of the needling.

According to one method of implementation, the support table is flat in the horizontal plane.

According to another method of implementation, the support table is curved in the vertical plane MD, in particular circular, cylindrical, in particular with a large radius of curvature with respect to the thickness of the table, in particular a radius/thickness ratio of between 10 and 100, in particular between 20 and 50.

According to a preferred method of implementation, a drilled plate forming a stripper could be provided, situated above the web or non-woven fabric to be consolidated, the stripper comprising through holes, that may be holes according to the invention or circular, cylindrical holes.

The present invention also relates to a process of manufacturing a table with holes according to the invention, that consists of stages in which a table is taken and an array of through holes is formed in it using at least one circular, cylindrical drill, each circular, cylindrical drill approaching the material, in particular the metal sheet, of the table with its axis inclined to the vertical to the table, or inclined to the normal to the tangent in the case of a circular, cylindrical table, first drilling through the table, then approaching again at an inclined angle of opposite sign to the previous angle to drill a second through hole in the table, the second approach being displaced from the first drilling.

The present invention also relates to another process of manufacturing a table with holes according to the invention, consisting of stages in which a table is taken and an array of through holes is drilled in it using at least one circular, cylindrical drill, each circular, cylindrical drill approaching the material, in particular the metal sheet, of the table with its axis inclined to the vertical to the table, or inclined to the normal to the tangent in the case of a circular, cylindrical table, first drilling through the table, the drill is chased in the material to a position inclined at an opposite angle to the first drilling to produce the final hole.

The present invention also relates to a drilled support table, flat or curved, in particular cylindrical, for a needle machine, as defined in claim 10.

Preferably, the edge of the upper opening is in the form of a slot, that is, in the horizontal plane parallel to the direction CD and the direction MD or the horizontal plane CD-MD, has a greater dimension in the direction MD than in the direction CD and/or the edge of the lower opening is in the form of a slot, that is, in the horizontal plane parallel to the direction CD and to the direction MD or the horizontal plane CD-MD, is greater in the direction upper MD at the widest part in the direction CD.

Preferably, the edge of the upper opening and/or the edge of the lower opening, in the horizontal plane, that is in the plane parallel to the direction MD and to the direction CD, consist(s) of two circular arcs or quasi circular arcs, in particular of the same radius, each subtending an angle greater than 180° but less than 360°, with the distance between the two centres less than the sum of their two radii, in particular less than double the radius in the case where they have the same radius, forming a figure-8.

In particular, a number of holes, in particular the majority of holes, preferably essentially all the holes, even more preferably each hole is machined so that it has a longitudinal section with a greater dimension MD in which the respective upper opening of the hole is greater in the direction MD and, in this longitudinal section of greater dimension MD, the inner sidewall of the hole is defined, at least in the upper region, by two left and right lines inclined to the vertical and converging downwards, the angles of inclination of the two lines to the vertical being of opposite sign and in particular each has an absolute value of between 2 and 30° respectively, in particular of the same absolute value.

Preferably, the table is curved, in particular in a circular, cylindrical shape, in the vertical plane MD.

The present invention also relates to a flat or curved stripper, in particular cylindrical, drilled for a needle machine, as defined in claim 10.

Preferably, the edge of the upper opening is in the form of a slot, that is, in the horizontal plane parallel to the direction CD and to the direction MD or the horizontal plane CD-MD has a greater dimension in the direction MD than in the direction CD and/or the edge of the lower opening is in the form of a slot, that is, in the horizontal plane parallel to the direction CD and to the direction MD or the horizontal plane CD-MD, has a greater dimension in the direction MD than the greatest dimension in the direction CD.

Preferably, the edge of the upper opening and/or the edge of the lower opening, in the horizontal plane, that is in the plane parallel to the direction MD and to the direction CD, consist(s) of two circular arcs or quasi circular arcs, in particular of the same radius, each subtending an angle greater than 180° but less than 360°, with the distance between the two centres less than the sum of their two radii, in particular less than double the radius in the case where they have the same radius, forming a figure-8.

In particular, a number of holes, in particular the majority of the holes, preferably essentially all the holes, even more preferably each hole is machined so that there is a longitudinal section of greater dimension MD in which the respective upper opening of the hole a is greater in the direction MD and, in this longitudinal section of grater dimension MD, the inner sidewall of the hole is defined, at least in the upper region, by two left and right lines inclined to the vertical and converging downwards, the angles of inclination of the two lines to the vertical being of opposite sign and in particular each has an absolute value of between 2 and 30° respectively, in particular having the same absolute value.

Preferably, the stripper is curved, in particular of circular, cylindrical shape, in the vertical plane MD.

As an example, a preferred method of implementation of the invention will now be described with reference to the drawings in which:

FIG. 1 is a general view of a needle machine according to the invention;

FIG. 2 is a longitudinal, cross-sectional view (that is in the vertical plane in the direction MD) of part of the drilled table and some needles;

FIG. 3 is a perspective view of a hole formed in the support table in FIG. 2 according to one method of implementation of the invention;

FIG. 4 is a view from above of the hole in FIG. 3;

FIG. 5 is a longitudinal, cross-sectional view of the greater dimension MD of the hole in FIGS. 3 and 4 (this is the cross-section on A-A in FIG. 4);

FIG. 6 is a perspective view of another method of machining a hole in the support table;

FIG. 7 is a view from above the hole in FIG. 5; and

FIG. 8 is a longitudinal, cross-sectional view of the greater dimension MD of the hole in FIGS. 6 and 7 (this is the cross-section on A-A in FIG. 7).

FIG. 1 shows a needle machine according to the invention. The needle machine comprises a plate 1 with needles 2 and means for imparting an elliptical motion to the machine 1 with needles 2, meaning that the point of the needle follows an elliptical path with one component of its motion vertical and one component in the direction MD.

This type of needle machine with elliptical motion is well known in the field and the control mechanism will not be described in further detail here. If desired, one could refer to FR-A1-2909104 for a more complete description of a method of implementation of such a needle machine.

The needle machine in FIG. 1 comprises a support table 3 in which four through holes have been drilled. The table is shown in FIG. 1 supporting a web or mat of fibre (F) passing from left to right in front of the needles in FIG. 1, this direction being called the direction MD (Machine Direction or Direction Machine), that is, the direction in which the web moves while supported by the support table.

A stripper could also be provided (not shown in the diagrams), namely a drilled plate, positioned above the non-woven web that is traversed by the reciprocating needles. The stripper may have identical holes to those in the support table.

In addition, the support table is shown in FIG. 2 in the form of a circular support table with a large radius of curvature, the concave side of the table facing towards the needle plate. However, according to another method of implementation, one could also provide a flat support table with a straight section, arranged horizontal or inclined to the horizontal.

The holes 4 are machined in a form that could be as shown in FIGS. 2 to 5.

Each hole extends from the upper surface of the table to the lower surface, terminating with two upper lower openings 5 and 6 respectively. The sidewall 7 of the hole extends between openings 5 and 6. FIG. 4 shows a view from above of the hole 4. The opening edge 5 consists of two sections, left 8 and right 9 respectively, in circular arcs each subtending an angle of over 180°, for example 270°, with preferably the same radii, but whose centres are spaced apart by a distance less than the sum of the two radii so it is shaped liked a FIG. 8. One could also define the longitudinal cross section of greater width in the direction MD of the hole as in cross-section A-A, which corresponds to the greater dimension L of the opening 5. This section corresponds to the cross-section in the longitudinal plane, that is the plane comprising the direction MD and the vertical direction and passing by the straight line linking the two points furthest from the edge of the opening 5. The cross-section in this plane of greater length is shown in FIG. 2. The sidewall 7 is defined here by the four lines, upper right 10, upper left 11, lower left 12 and lower right 13, respectively.

Above was described the fact that the two sections 8 and 9 in circular arcs have the same radius. However, according to the invention, circular arcs of different radii could still be provided.

As shown in FIG. 2, the lengths of the four lines 10, 11, 12 and 13 could be made the same. However, one could also have different lengths, in particular different lengths between the upper and lower and lines.

Lines 10 and 11 are inclined to the vertical axis by respective angles of opposite signs and absolute values of between, for example, 2° and 15°, preferably between 5° and 10°, so that these two lines converge downwards. The two angles could have the same absolute value, as shown, or have different values. Lines 12 and 13 are inclined to the vertical axis by respective angles of opposite sign and with absolute values of between, for example, 2° and 15°, preferably between 5° and 10°, so that these two lines converge upwards. The two angles could have the same absolute value, as shown, or different values.

The inclinations with respect to the vertical axis 14 of the lines 10, 11, 12 and 13 of the hole may preferably be such that line 12 is parallel to line 10 and line 13 is parallel to line 11.

FIGS. 6 to 8 show another possible method of machining the holes according to the invention. FIG. 7 shows the edge of the upper opening 5' of a hole machined in this way. Each hole extends from the upper surface of the table to the lower surface, terminating in two openings, upper 5' and lower 6' respectively. The sidewall 7' of the hole extends between openings 5' and 6'. The edge of the opening 5' has two sections, left 18 and right 19 respectively, in circular arcs of the same radius and each subtending an angle of 180°. The two semicircular sections 18 and 19 are separated by two parallel straight sections 20 and 21 extending in the direction MD, so that the edge of the upper opening is in the form of a slot. One can then define the greatest longitudinal cross-section in the direction MD of the hole according to the cross-section A-A', which corresponds to the greater dimension L' of the opening 5'. This cross-section corresponds to that in the longitudinal plane, that is the plane comprising the direction MD and the vertical passing the straight line linking the two points of the edge of the opening furthest from each other 5'. The greater cross-section in this plane is shown in FIG. 8. The sidewall 7' is here defined by four lines, upper right 10', upper left 11', lower left 12' and lower right 13' respectively.

As shown in FIG. 8, the lengths of the four lines 10', 11', 12' and 13' can be made the same. However, they could also be of different lengths, in particular different lengths between the upper lines and the lower lines.

Lines 10' and 11' are inclined to the vertical axis by respective angles of opposite sign and with absolute values of between, for example 2° and 15°, preferably between 5° and 10°, so that the two lines converge downwards. The two angles can be made the same absolute value, as shown, or of different values. Lines 12' and 13' are inclined to the vertical axis at respective angles of opposite sign and absolute values of between, for example between 2° and 15°, preferably between 5° and 10°, so that the two lines converge upwards. The two angles can be made the same absolute value, as shown, or they may have different values.

The inclinations to the vertical axis 14' of the hole of the lines 10', 11', 12' and 13' may preferably be such that line 12' is parallel to line 10' and line 13' is parallel to line 11'.

In the two methods of implementation the shape of the upper openings 5, 5' respectively is described in FIGS. 3 to 5 and 6 to 8. It should be noted that in these two methods of implementation, the lower openings 6 and 6' have the same shape and size as those described for the upper openings. In addition, a single needle only passes through one hole at time.

According to other methods of implementation, however, holes could have upper and lower parts that are not symmetrical in relation to the median plane, as well as upper and lower openings of different sizes. This is the case when the holes are machined in a circular, cylindrical table, owing to the curvature of the plate. Depending on the thickness of the table and the position of the plane separating the upper and lower lines from the inner sidewall, there could also be upper and lower openings of different shapes. There could also be a sidewall with only the upper (or lower) region described above, that is with a longitudinal cross-section with a greater dimension MD with only two upper (or lower) left and right lines inclined with respect to each other, that is holes of V or inverted V cross-section and not X as described in the diagrams.

A manufacturing process for a table with holes as described in FIGS. 3 to 5, consists in taking a plate, for example of steel, flat or curved (in particular circular, cylindrical or part circular, cylindrical) and forming in it an array of through holes 4 using a circular, cylindrical drill, the circular, cylindrical drill approaching the material, in particular the steel sheet, of the table with its axis inclined to the vertical of the table, or inclined to the normal to the tangent in the case of a circular, cylindrical table, to drill the first through holes in the table, another approach is then made, with same drill or a different drill, in particular of different radius, at an inclined angle of opposite sign to the previous angle to drill a second array of through holes in the table, the said other approach being at a distance from the first drilling, but however having a common region with it thereby producing a hole with a shape according to the method of implementation shown in FIGS. 3 to 5.

Another manufacturing process for a table with holes according to FIGS. 6 to 8, consists in taking a plate, for example of steel, flat or curved (in particular circular, cylindrical or in part circular, cylindrical) and forming in it the array of through holes 4' using a circular, cylindrical drill, the circular, cylindrical drill approaching the material, in particular the steel sheet, of the table with its axis inclined to the vertical of the table, or inclined to the normal to the tangent in the case of a circular, cylindrical table, to drill the first through holes in the table, then chasing the drill in the material up to an inclined position of opposite sign to the inclination of the first drilling thereby producing the final hole with a shape according to the method of implementation shown in FIGS. 6 to 8.

In the methods of implementation shown in the diagrams, the greater dimension (L or L') in the direction MD of the edges of the upper and lower openings is greater than the largest dimension in the direction CD (This dimension is equal to the radius (or to the greater of the two radii in the case of a non-symmetrical eight) of the circular arcs forming the eight or to the radius of the two semi-circles of the slot).

The invention claimed is:

1. A needle machine comprising at least one plate, from which projects an array of needles, means for imparting an elliptical, reciprocating motion to the needles, and at least one support table drilled with an array of through holes, over which a fabric or a web of fibers is intended to pass in a direction MD, the needles having a reciprocating motion following the elliptical motion in the respective through holes, each hole having an upper respective opening in a side of the support table, a lower respective opening in an opposite side of the support table and an inner sidewall extending between the upper and lower openings, characterized in that at least one hole is machined so that in a greater MD dimension longitudinal section, the upper respective opening of the hole has a largest dimension in the direction MD and, in this said greater MD dimension longitudinal section, the inner sidewall of the hole is defined, starting from the upper opening, by left and right lines inclined to the vertical and converging downwards, angles of inclination of the two lines to the vertical being of opposite sign, and the support table consisting of steel.

2. The needle machine according to claim 1, characterized in that an edge of the upper opening is in the form of a slot, that is, in a horizontal plane parallel to a direction CD and to the direction MD, or horizontal plane CD-MD, has a largest dimension in the direction MD greater than the largest dimension in the direction CD and/or an edge of the lower opening is in the form of a slot, that is, in a horizontal plane parallel to the direction CD and to the direction MD, or horizontal plane CD-MD, has a largest dimension in the direction MD greater than the largest dimension in the direction CD.

3. The needle machine according to claim 2, characterised in that the edge of the upper opening and/or the edge of the lower opening, in the horizontal plane CD-MD is/are in the form of a slot, comprising two ends in the form of quasi semicircular arcs, linked together by two straight sections.

4. The needle machine according to claim 1, characterized in that a cross section of the support table in a plane comprising the MD direction and the vertical direction is curved.

5. The needle machine according to claim 1, characterized in that the angles of inclination of the two lines to the vertical each have an absolute value of between 2° and 30°.

6. The needle machine according to claim 1, characterized in that the angles of inclination of the two lines to the vertical have a same absolute value.

7. The needle machine according to claim 2, wherein the edge of the upper opening and/or the edge of the lower opening, in the horizontal plane CD-MD, consist(s) of two circular arcs, or quasi circular arcs, each subtending an angle of greater than 180° but less than 360°, where a distance between the two centers of the arcs is less than the sum of their two radii.

8. The needle machine according to claim 1, wherein in the said greater MD dimension longitudinal section, the inner sidewall is defined by an upper right line, a lower right line, a lower left line and an upper left line, the upper right and left lines each being inclined to the vertical and converging downwards, the lower right and left lines each being inclined to the vertical and converging upwards, the upper left line being parallel to the lower right line and the lower left line being parallel to the upper right line.

9. A needle machine comprising at least one plate, from which projects an array of needles, means for imparting an elliptical, reciprocating motion to the needles, and at least one support table drilled with an array of through holes, over which a fabric or a web of fibers is intended to pass in a direction MD, the needles having a reciprocating motion following the elliptical motion in the respective through holes, each hole having an upper respective opening in a side of the support table, a lower respective opening in an opposite side of the support table and an inner sidewall extending between the upper and lower openings, wherein at least one hole is machined so that in a greater MD dimension longitudinal section, the upper respective opening of the hole has a largest dimension in the direction MD and, in this said greater MD dimension longitudinal section, the inner sidewall of the hole is defined, at least in an upper region, by left and right lines inclined to the vertical and converging downwards, angles of inclination of the two lines to the vertical being of opposite sign, an edge of the upper opening is in the form of a slot, that is, in a horizontal plane parallel to a direction CD and to the direction MD, or horizontal plane CD-MD, has a largest dimension in the direction MD greater than the largest dimension in the direction CD and/or an edge of the lower opening is in the form of a slot, that is, in horizontal plane parallel to the direction CD and to the direction MD, or horizontal plane CD-MD, has a largest dimension in the direction MD greater than the largest dimension in the direction CD, characterized in that the edge of the upper opening and/or the edge of the lower opening, in the horizontal plane CD-MD, consist(s) of two circular arcs, or quasi circular arcs, each subtending an angle of greater than 180° but less than 360°, where a distance between the two centers of the arcs is less than the sum of their two radii.

10. The needle machine according to claim 9, characterized in that a distance between the two centers is less than double the radius in the case where they are of the same radius, to form a FIG. 8 shape.

11. A needle machine comprising at least one plate, from which projects an array of needles, means for imparting an elliptical, reciprocating motion to the needles, and at least one support table drilled with an array of through holes, over which a fabric or a web of fibers is intended to pass in a direction MD, the needles having a reciprocating motion following the elliptical motion in the respective through holes, each hole having an upper respective opening in a side of the support table, a lower respective opening in an opposite side of the support table and an inner sidewall extending between the upper and lower openings, wherein at least one hole is machined so that in a greater MD dimension longitudinal section, the upper respective opening of the hole has a largest dimension in the direction MD and, in this said greater MD dimension longitudinal section, the inner sidewall of the hole is defined, at least in an upper region, by left and right lines inclined to the vertical and converging downwards, angles of inclination of the two lines to the vertical being of opposite sign, characterized in that, in the said greater MD dimension longitudinal section, the inner sidewall is defined by an upper right line, a lower right line, a lower left line and an upper left line, the upper right and left lines each being inclined to the vertical and converging downwards, the lower right and left lines each being inclined to the vertical and converging upwards, the upper left line being parallel to the lower right line and the lower left line being parallel to the upper right line.

12. The needle machine according to claim 11, characterized in that the angles of inclination to the vertical of the lower right, lower left, upper right and upper left lines are equal to each other in absolute value, so that at least in the longitudinal section with the greater dimension MD, the wall is essentially symmetrical in relation to the vertical plane CD.

13. The needle machine according to claim 11, characterized in that points where the upper left line and the lower left line and the lower right line and the upper right line respectively join, are essentially half way between the two upper and lower openings.

* * * * *